US010184214B2

(12) United States Patent
Keinberger et al.

(10) Patent No.: US 10,184,214 B2
(45) Date of Patent: Jan. 22, 2019

(54) SEALING STRIP SYSTEMS FOR SUCTION ROLLS

(71) Applicant: ROCHLING LERIPA PAPERTECH GMBH & CO. KG, Osterreich (AU)

(72) Inventors: Rudiger Keinberger, Osterreich (AT); Peter Eckerstorfer, Osterreich (AT); Markus Ecker, Osterreich (AT); Anton Luger, Osterreich (AT)

(73) Assignee: ROCHLING LERIPA PAPERTECH GMBH & CO. KG, Osterreich (AT)

( * ) Notice: Subject to any disclaimer, the term of this patent is extended or adjusted under 35 U.S.C. 154(b) by 0 days.

(21) Appl. No.: 15/511,012

(22) PCT Filed: Sep. 14, 2015

(86) PCT No.: PCT/AT2015/050228

§ 371 (c)(1),
(2) Date: Mar. 15, 2017

(87) PCT Pub. No.: WO2016/040974

PCT Pub. Date: Mar. 24, 2016

(65) Prior Publication Data

US 2017/0254019 A1 Sep. 7, 2017

(30) Foreign Application Priority Data

Sep. 15, 2014 (AT) ..... A 50641/2014

(51) Int. Cl.
*D21F 3/10* (2006.01)
*D21F 3/02* (2006.01)

(52) U.S. Cl.
CPC ..... *D21F 3/10* (2013.01); *D21F 3/02* (2013.01); *D21F 3/0281* (2013.01)

(58) Field of Classification Search
CPC ..... D21F 3/10; D21F 7/00; D21F 1/50; D21F 3/02; D21F 3/0281; F16C 13/00; F16J 15/162; D21G 1/02
See application file for complete search history.

(56) References Cited

U.S. PATENT DOCUMENTS 2,312,519 A * 3/1943 Berry ..... D21F 3/10 162/371
2,578,551 A * 12/1951 Hornbostel ..... D21F 3/10 162/371
5,580,424 A * 12/1996 Snellman ..... D21F 3/10 162/368
6,241,854 B1 * 6/2001 Frawley, Jr. ..... D21F 3/10 162/371
6,302,399 B1 * 10/2001 Prinzing ..... D21F 1/483 162/371

(Continued)

FOREIGN PATENT DOCUMENTS

AT 516191 B1 * 8/2016 ..... D21F 3/10
AT 516210 B1 * 4/2017 ..... D21F 3/10

(Continued)

*Primary Examiner* — Jose A Fortuna
(74) *Attorney, Agent, or Firm* — FisherBroyles LLP; Anthony Dovale

(57) ABSTRACT

Sealing strip holder for suction rolls used for dewatering of sheeting e.g. for paper machines comprises a roll shell with openings and disposed within at least one suction box and methods of using the same.

20 Claims, 3 Drawing Sheets

(56) References Cited

U.S. PATENT DOCUMENTS

Figure 1:
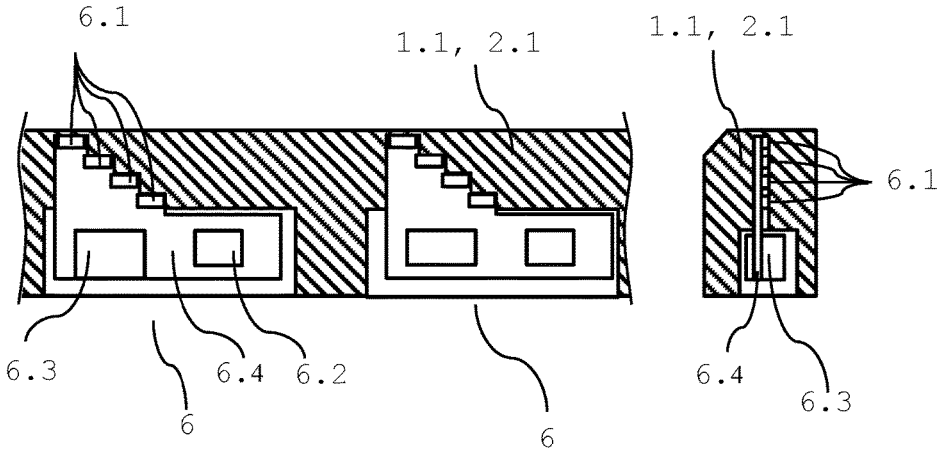

| | | | | |
|---|---|---|---|---|
| 6,334,934 | B1 * | 1/2002 | Heinzmann | D21F 3/10 162/367 |
| 6,436,241 | B1 * | 8/2002 | Persson | D21F 3/10 162/272 |
| 7,090,219 | B2 * | 8/2006 | Schrefl | D21F 3/10 162/371 |
| 7,144,477 | B2 * | 12/2006 | Gleason, Jr. | D21F 3/10 162/198 |
| 7,569,265 | B2 * | 8/2009 | Boga | C09K 3/10 162/369 |
| 9,447,542 | B2 * | 9/2016 | Erkelenz | D21F 1/50 |
| 9,650,743 | B2 * | 5/2017 | Erkelenz | D21F 7/00 |
| 9,708,768 | B2 * | 7/2017 | Erkelenz | D21F 3/10 |
| 2002/0060030 | A1 * | 5/2002 | Heinzmann | D21F 3/10 162/270 |
| 2002/0175477 | A1 * | 11/2002 | Schrefl | D21F 3/10 277/552 |
| 2003/0051849 | A1 * | 3/2003 | Ehrola | D21F 3/10 162/368 |
| 2004/0168603 | A1 * | 9/2004 | Boga | C09K 3/10 101/494 |
| 2004/0195779 | A1 * | 10/2004 | Schrefl | D21F 3/10 277/549 |
| 2005/0126732 | A1 * | 6/2005 | Gleason, Jr. | D21F 3/10 162/198 |
| 2009/0000753 | A1 * | 1/2009 | Vestola | D21F 3/10 162/371 |
| 2015/0184340 | A1 * | 7/2015 | Erkelenz | D21F 3/10 162/374 |
| 2015/0191872 | A1 * | 7/2015 | Erkelenz | D21F 3/10 277/500 |
| 2015/0204014 | A1 * | 7/2015 | Erkelenz | D21F 3/10 277/300 |
| 2016/0153141 | A1 * | 6/2016 | Erkelenz | D21F 3/10 162/373 |
| 2017/0159818 | A1 * | 6/2017 | Erkelenz | F16J 15/162 |
| 2017/0254019 | A1 * | 9/2017 | Keinberger | D21F 3/02 |
| 2017/0254020 | A1 * | 9/2017 | Keinberger | D21F 3/10 |
| 2018/0017162 | A1 * | 1/2018 | Erkelenz | F16C 13/00 |
| 2018/0119355 | A1 * | 5/2018 | Erkelenz | D21D 5/023 |

FOREIGN PATENT DOCUMENTS

| | | | | |
|---|---|---|---|---|
| DE | 10325686 | A1 * | 12/2004 | D21F 3/10 |
| DE | 102004059028 | A1 * | 6/2006 | D21F 3/10 |
| DE | 102004062107 | A1 * | 7/2006 | D21F 3/10 |
| DE | 102005052552 | A1 * | 5/2007 | D21F 3/10 |
| DE | 102012208811 | B3 * | 7/2013 | D21F 3/10 |
| DE | 102012207692 | A1 * | 11/2013 | D21F 3/10 |
| DE | 102012213544 | A1 * | 2/2014 | D21F 3/10 |
| EP | 0738801 | A2 * | 10/1996 | D21F 3/10 |
| EP | 1239076 | A2 * | 9/2002 | D21F 3/10 |
| EP | 1479820 | A1 * | 11/2004 | D21F 3/10 |
| EP | 2847381 | B1 * | 8/2016 | D21F 3/10 |
| GB | 778779 | A * | 7/1957 | D21F 3/10 |
| WO | WO-2007003698 | A1 * | 1/2007 | D21F 3/10 |
| WO | WO-2013167656 | A1 * | 11/2013 | D21F 3/10 |
| WO | WO-2016040975 | A1 * | 3/2016 | D21F 3/10 |

* cited by examiner

SEALING STRIP SYSTEMS FOR SUCTION ROLLS

FIELD OF THE INVENTION

The present invention relates to sealing strip systems for suction rolls and methods of using the same for control or regulation of them.

BACKGROUND OF THE INVENTION

A suction roll used for dewatering of sheeting e.g. for paper machines comprises a roll shell with openings and disposed within at least one suction box. The suction box is arranged stationary on the inside of the suction roll with the holey roll shell rotating around the suction box. To seal the suction box from the roll shell, said roll shell comprises lateral sealing strips which seal the inside of the suction box from the remaining volume of the suction roll, preferably in longitudinal direction of the suction roll. The suction box is delimited on both ends in peripheral direction of the suction roll by edge deckles and sealed from the roll shell.

Specific problems during construction and/or operation of suction rolls consist in the abrasion of sealing strips and the generation of noise near the sealing strips.

EP0943729 B1 discloses a sealing strip, which is pressed against the inner wall of the suction roll by a load element in form of a pressure hose when the vacuum is created within the suction box.

During operation, the sealing strip is pushed away somewhat from the inner wall of the suction roll by a resetting element, which is provided as well in form of a pressure hose, this leads to a defined, adjustable sealing gap. It is intended for noise reduction that the gap between the sealing strip and the inner wall in peripheral direction widens gradually.

The EP1348805 B1 has disclosed the implementation of a sealing strip with adjustable sealing gap with the adjustment of the gap via a vertically adjustable strip by a pressure hose, which are hingedly connected to the rear end of the sealing strip.

The EP1344865 B1 shows a suction roll in which a microphone is installed on the inside of the suction roll in the area of the rear sealing strip of the suction box. If the measured sound level exceeds a certain threshold, countermeasures are being implemented which can consist of the adjustment of the gap between the sealing strip to the inner wall and/or the adjustment of the opening angle of the strip between suction strip and inner wall.

DE102007027688 A1 discloses the integration of several temperature sensors into the sealing strip, which are assembled along the longitudinal direction of the sealing strip, i.e. transverse direction of the paper machine. Once the threshold temperature has been reached, the gap between the sealing strip and the roll shell is increased. It is assumed additionally that the negative pressure inside the suction box will be monitored. If the negative pressure decreases, the sealing strip is moved back again into the direction of the inner wall. Subsequently, the gap and/or the contact pressure and/or advancing pressure of the sealing strip in the area between the threshold value of the temperature and the threshold value of the pressure drop will be regulated. Adversely, it can lead to a slow or failed adjustment and/or if a threshold value cannot be achieved without ignoring the second threshold value, no appropriate countermeasures can be implemented.

WO2013174573 A1 discloses in the sealing strip the provision of several electrical conductors in form of a ribbon cable, which extends over the entire length of the sealing strip in order to monitor the abrasion of the sealing strip. The individual conductors are embedded in varying depths into the sealing strip, thus said conductors are consecutively cut after abrasion of the sealing strip. Adversely, only the maximum value of abrasion is known and an uneven abrasion of the sealing strip stays undetectable.

DE102005048054 A1 discloses the regulation of the advancing pressure of the control device of the sealing strip in such a way, that the entire contact pressure remains consistent. The entire contact pressure is comprised of the advancing pressure of the control device of the sealing strip and an element produced by the vacuum inside of the suction box, said element acts through the openings of the suction roll upon the sealing strip.

Adversely, the state of the art provides no satisfactory overall concept for the failsafe, low noise and low resource operation of a suction roll.

BRIEF SUMMARY OF THE INVENTION

The objective of the present invention is the provision of a simplest possible device as well as a method for enabling optimal operation of the suction roll. Other objectives of the present invention are first the optimization of the amount of lubricant; second the reduction and monitoring of abrasion, third the minimization of noise.

As solution to these problems it has been suggested to provide the suction roll with the design of a combination of sensors and actuating elements, thus ensuring optimal operational conditions with the inventive control method.

The inventive device consists of a suction roll containing a suction box, which is delimited laterally by the sealing strips.

Each sealing strip is assigned a lubricant water supply, which insert lubricant, viewed from the direction of travel, in front of the sealing strip in the direction of the inner wall of the holey shell of the suction roll. Each sealing strip comprises at least one actuator with which the advancing pressure of the sealing strip can be adjusted to the inner shell surface of the suction roll. The second rear sealing strip, viewed from the direction of travel, comprises additionally a second actuator, with which the opening angle of the gap between sealing strip and suction roll shell can be adjusted. The second rear sealing strip, viewed from the direction of travel, comprises an electro-acoustic transducer, which is preferably integrated into the mountings of the sealing strip and thus protected from humidity. The sealing strips comprise temperature sensors which preferably also serve to measure abrasion. According to the invention it is envisaged, that the data of the sensors is processed in a miniserver and the actuators can be controlled via the mini-server.

A mini-server is a miniaturized data processing unit with input and output modules and the ability for digital communication, in particular for wireless communication with input and output apparatuses and other data processing units in a network.

The invention consists of several sub-sections in particular with the combination of these sub-sections enabling particular advantageous methods for the operation of the representational device.

The first sub-section consists of a combination of monitoring temperature and abrasion of the sealing strip.

The second sub-section consists of the regulated and preferably measurable use of lubricant.

The third sub-section consists of the minimization of the abrasion of the sealing strip.

The fourth sub-section consists of the minimization of noise emissions.

According to the invention, it is suggested to measure the temperature of the sealing strip for optimized use of lubricant and to control and/or regulate the lubricant water usage and/or lubricant water amount on the basis of the measured temperature.

For this the temperature can be measured in one or several points of the sealing strip and the amount of lubricant inserted along the length of the sealing strip can be consistent in each area of the sealing strip.

If the temperature of the sealing strip is measured in several areas of the sealing strip, the local temperature curve in the sealing strip can be determined. Preferably, the inserted amount of lubricant can be controlled and/or regulated separately in each individual area of the longitudinal extent of the sealing strip, thus enabling the insertion of lubricant water only into the affected area in case of local heat production in the sealing strip.

Due to the heat production in the sealing strip as a result of friction on the inner shell surface of the suction roll and the reduction of said friction by the lubricant water, the required lubricant water amount can thus be inserted exactly, said lubricant water amount is necessary to keep the friction and thus abrasion low.

For the above described method it is necessary to determine, as closely as possible to the surface, the temperature of the sealing strip, with which the sealing strip grates against the inner shell surface of the suction roll. For this purpose, it is preferable to mount the temperature sensor on the inside of the sealing strip, according to DE102007027688 A1. The distance between the temperature sensors of DE102007027688 A1 and said surface should thereby be high enough so that these remain integrated into the material of the sealing strip until the maximum permitted abrasion is reached.

The inventive improvement proposes integration of several temperature sensors into the sealing strip with implementation and/or integration of these temperature sensors into the sealing strip with varying depths. More preferable is thus that the temperature sensors can also be used for monitoring and/or measuring abrasion. This occurs through breakage of the temperature sensors as soon as they are no longer protected by the material of the sealing strips and wear out at the suction roll.

Several such temperature sensors are always preferable that are displaced in staggered depthwise manner combined in a sensor unit with mounting of preferably several such sensor units distributed along the longitudinal direction of the sealing strip.

Thus the local temperature curve in the sealing strip and the local abrasion of the sealing strip can be monitored and/or this data can be transmitted to a control or regulation unit.

Regulating the position and/or the advancing pressure of the sealing strip on the basis of the sealing strip temperature and the pressure of the inside of the suction box is known from the state of the art.

According to the invention it is proposed to regulate the position and/or the advancing pressure of the sealing strip only on the basis of the pressure on the inside of the suction box, wherein the usage of lubricant can be regulated via the determination of the temperature. This is advantageous due to the fact that the actuator can be executed more easily for the adjustment of the advancing pressure of the sealing strip, because the force applied by the actuator onto the length of the strip can be constant and there is no need to exert a negative force onto the sealing strip, since said negative force results in a reduction of the advancing pressure. Additionally, no clamping device is needed to secure the sealing strip, which is used in other suction rolls known to the prior art, in order to determine the sealing strip in a defined distance from the roll shell. Additionally, the risk of unauthorized operating modes is reduced, since a higher temperature and/or friction are fixed through the use of lubricant and not through adjustment of the advancing pressure which leads to a reduced vacuum. The method known from the state of the art, however, requires to maintain a certain "advancing pressure reserve", since it would not be possible otherwise to compensate for a rise in temperature without weakening the vacuum.

The advancing pressure of the sealing strip onto this minimum is regulated by the inventive regulation, which is required in order to maintain the vacuum in the determined/determinable strength. In this operation mode the minimal abrasion required for the respective other operating parameters of the suction roll is achieved and/or the minimum abrasion achievable for the respective other operating parameters is reached, since the abrasion is based on the friction and thus on the advancing pressure. If this minimal achievable abrasion is too high due to any reason such as unfavorable operation parameters, contamination or any other failure, the friction is reduced with the use of lubricant water. An additional usage of the lubricant water is the ability to remove contamination, such as for example paper fibers, from the sealing strip.

The invention provides an improvement to the state of the art for integrating a spray tube into the sealing strip mounting. Thus, the lubricant water can be inserted very close to the friction surface, therefore the surface, with which the sealing strip grates against the roll shell as well as the space requirement can be reduced in comparison to a spray tube mounted in front of the sealing strip mounting. Compared with a lubricant water system, which is integrated into the sealing strip, there are advantages that result in a friction surface that is not reduced by the openings of the lubricant water supply and a simpler design of the sealing strip. The spray tube or the conduit leading to the spray tube comprises preferably of a flow sensor which has established a data connection with the miniserver in order to monitor the amount of spray water used in real time. The flow rate is controlled or regulated for example by adjusting the valve.

It is particularly advantageous when the above described method is implemented with the help of a sealing strip with the above described temperature sensors with abrasion detection, since the temperature is always measured very close to the surface, on which the friction occurs and thus a very quick reaction even to the slightest temperature rise can be ensured. Additionally, insofar as individually controllable lubricant water nozzles are used or several individually controllable spray tubes per sealing strip system are used, the lubricant water can only be inserted into the area, in which a local temperature rise has been measured.

A further inventive aspect concerns the minimization of the noise level caused at the sealing strip. The sometimes very loud noise occurs when the shell of the suction roll, arriving from the vacuum of the suction box, passes the second sealing strip and the vacuum in the openings of the roll shell collapses suddenly.

This sudden ventilation is counteracted according to the state of the art by reducing the noise through gradual opening of the gap between sealing strip and shell of the suction roll.

It is known from EP1344865 B1 to monitor the noise level and to implement countermeasures in case a threshold value is exceeded.

The invention intends to measure the noise level and regulate to a minimum the opening angle of the gap by adjusting it. This is advantageous, since the lowest possible noise level is achieved for the respective operation parameter.

For creating an improved inventive adjusting mechanism for the opening angle of the gap to the state of the art, it is proposed based on EP1348805 B1 to not adjust the position of the rear end of the sealing strip via the pressure tube, but via a motor, in particular a stepping motor or servo motor which serves to shift a strip comprising at least one inclined surface and located under the sealing strip in longitudinal direction of the sealing strip, in order to facilitate a height adjustment of the sealing strip along the inclined surface. It is advantageous that the gap above the motor is adjustable to a highly exact degree and the necessity to use clamp elements and/or stoppers, such as is the case with the pressure tube embodiment, is eliminated. The inventive adjusting mechanism is thus easier and more exact in comparison with the state of the art, whereas the position of the rear end of the sealing strip can always be determined via the position information of the stepper motor.

The preferred combined regulation method of all subsections comprises the measurement of the temperature in the sealing strips, measurement of the vacuum in the suction box, measurement of the sound level after the second sealing strip, regulation of the advancing pressure of the sealing strips, regulation of the lubricant water amount and regulation of the opening angle of the second sealing strip, whereas the advancing pressure of the sealing strip is regulated to that minimum value which is required to maintain the vacuum within the suction box at the predeterminable value, regulate the lubricant water amount per sealing strip based on the temperature of the sealing strip and regulate the opening angle of the second sealing strip in order to keep the sound level at a minimum.

BRIEF DESCRIPTION OF THE SEVERAL DRAWINGS OF THE INVENTION

The invention provides for drawings for illustration purposes:

FIG. 1: Shows the design of an inventive sealing strip with inventive temperature sensors with abrasion detection.

Figure 2:
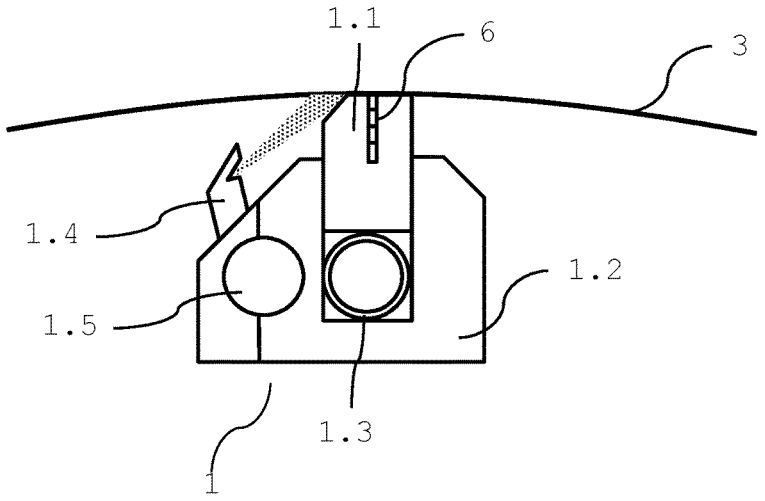

FIG. 2: Shows schematically an example of an inventive sealing strip system.

Figure 3:
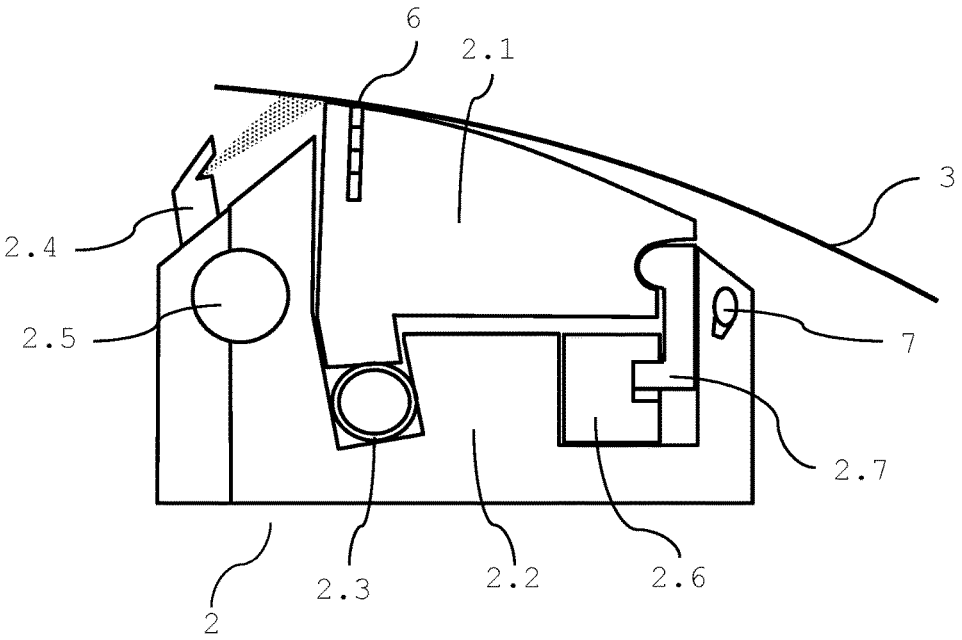

FIG. 3: Shows schematically an example of an inventive sealing strip system in a noise reducing embodiment.

Figure 4:
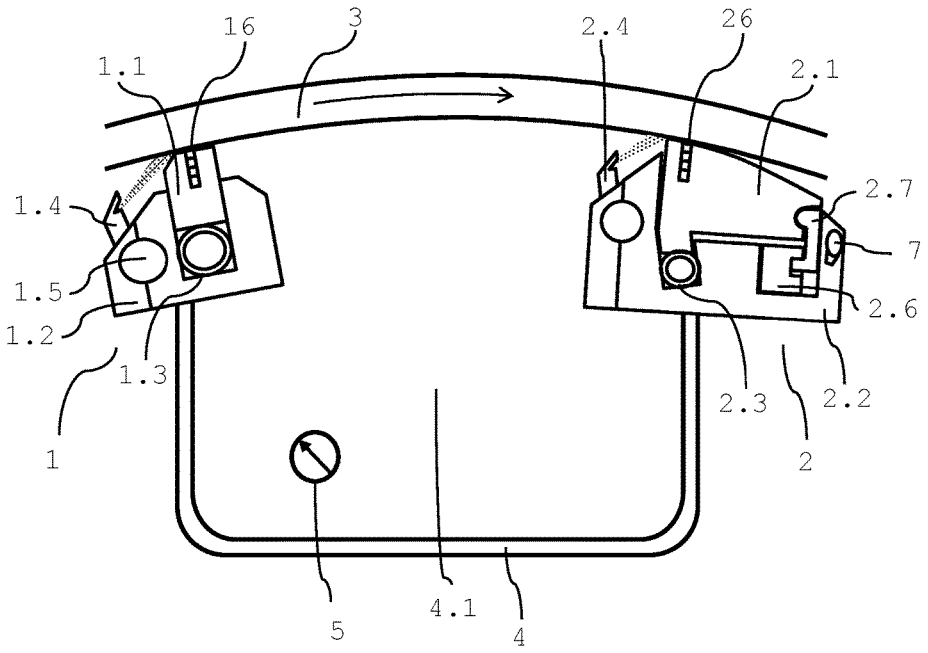

FIG. 4: Shows schematically a particularly preferred inventive sealing apparatus of a suction roll.

DETAILED DESCRIPTION OF THE INVENTION

FIG. 1 shows the inventive sealing strip 1.1, 2.1 with integrated temperature sensors 6.1. In this preferred embodiment, several sensor units 6 are integrated into the sealing strip 1.1, 2.1, whereas each sensor unit 6 comprises four temperature sensors 6.1. Regarding the upper surface i.e. the grate and/or friction surface of the sealing strip 1.1, 2.1, the temperature sensors 6.1 comprise different distances. The distance between two consecutively mounted temperature sensors 6.1 is for example 2 mm. The sensor units consist of a circuit board 6.4, temperature sensors 6.1, and a microchip 6.2 with integrated radio module and a power supply via battery 6.3. The setting of the sealing strip 1.1, 2.1 next to the rotating roll shell 3 results in friction and thus in a rise in temperature on the sealing strip 1.1, 2.1. This rise in temperature leads to a change in resistance on the temperature sensors 6.1 positioned on the circuit board 6.4, whereas the temperature is determined via the voltage change caused by the programmed microchip 6.2. If a temperature sensor 6.1 is cut, i.e. destroyed, it results in a disruption of the signal. Thus the microchip 6.2 is able to calculate the exact sealing strip abrasion via the signal disruption in the individual temperature sensors 6.1.

On the outside of the suction roll a mini-server with radio module is positioned which receives data from the sensor units 6 via radio. The mini-server is preferably connected to a network and the data can be visualized via an output device such as a computer, tablet, laptop or mobile phone.

The sealing strip 1.1, 2.1 comprises of one sensor unit 6, preferably the sealing strip 1.1, 2.1 comprises several sensor units 6, in order to facilitate measurement of the temperature in several locations on the sealing strip 1.1, 2.1.

FIG. 2 shows an inventive sealing strip system 1, viewed in direction of travel of the roll shell 3, which is used preferably as the first sealing strip system 1 of a suction box 4, as shown in FIG. 4. The sealing strip system 1 consists of a sealing strip 1.1, which is movably accommodated into the groove of the sealing strip mounting 1.2. An advancing tube 1.3, designed as a pressure tube is set into the groove below the sealing strip 1.1. In front of the sealing strip 1.1 is a sealing strip mounting 1.2 with a lubricant water system comprising spray nozzles 1.4 above which the lubricant water is inserted via a preferred spray tube integrated into the sealing strip mounting 1.2. Preferably at least one sensor unit 6 is integrated and/or inserted into the sealing strip 1.1. The advancing pressure, with which the sealing strip 1.1 is pressed against the inner wall of the roll shell 3, can be adjusted via the pressure in the advancing tube 1.3.

FIG. 3 shows an inventive sealing strip system 2, viewed preferably in direction of travel of the suction roll, which is used as second sealing strip system 2 of a suction box 4, as shown in FIG. 4. The sealing strip system 2 consists of a sealing strip 2.1, which comprises a stop ridge along the lower front edge and which is accommodated movably in the groove of the sealing strip mounting 2.2. The groove contains an advancing tube 2.3 under the stop ridge of the sealing strip 2.1. The sealing strip mounting 2.2 comprises in front of the sealing strip 2.1 of a lubricant water system with spray nozzles 2.4 through which the lubricant water is inserted via a spray tube 2.5, integrated preferably into the sealing strip mounting 2.2. Preferably at least one sensor unit 6 is integrated and/or inserted into the sealing strip 2.1. The advancing pressure with which the sealing strip 2.1 is pressed in the front area against the inner wall of the roll shell 3 can be adjusted via the pressure in the advancing tube 2.3. The sealing strip 2.1 comprises a curved upper surface, thus the upper surface in the front area rests against the roll shell 3 and a gradually increasing gab is formed with the roll shell 3 in the rear area. The width of this gap can be adjusted with a height adjustable strip 2.7, which can shift the rear end of the sealing strip 2.1 closer to the roll shell 3 or away from it.

The height adjustable strip 2.7 is led along a stop ridge that leads upwards at an angle of a sliding strip 2.6 in longitudinal direction of the sealing strip 2.1. The sliding strip 2.6 can be designed as a sliding carriage that is slid into the groove of the sealing strip mounting 2.2 via a motor powered adjusting spindle. A longitudinal displacement of the sliding strip 2.6 results in an upwards displacement of the height adjustable strip 2.7 along the groove. It is also possible to fixedly carry out the strip 2.6 and adjust its height along the groove by longitudinal displacement of the height adjustable strip 2.7. There are several possibilities to convert the rotation movement of the stepper motor into a linear movement of an actuating element, it should be noted that the distance of the rear end of the sealing strip 2.1 to the roll shell 3 is adjustable via a motor and can be held in the respective position.

The sealing strip mounting 2.2 contains preferably a symbolically illustrated sound sensor 7 and/or a pick-up which is used for measuring the noise level on and/or behind the sealing strip 2.1. The inventive regulation method proposes the regulation of the opening angle of the gap between the sealing strip 2.1 and roll shell 3 in such a way that the noise level is reduced to a minimum.

In general, it should be noted with reference to FIG. 4 that instead of pressure tubes 1.3, 2.3 other adjusting devices known to the state of the art can be used on the sealing strip 1.1 and the front end of the sealing strip 2.1. Thus, in addition to the pressure tubes it can comprise clamp devices for fixate the sealing strip in its position temporarily or after achieving a stable, optimal operation mode. Additionally, as known from EP0943729 B1, an additional pressure tube can exist which acts upon the sealing strip in opposite direction of the first pressure tube (advancing tube) in order to be able to "pull it away" from the roll shell.

According to the invention it is also possible to provide an adjustment mechanism, such as used in the rear area of the sealing strip 2.1, for adjusting the sealing strip 1.1 and the front area of the sealing strip 2.1. The use of an advancing tube is hereby not mandatory. Since, contrary to the rear end of the sealing strip 2.1, its front area and the sealing strip 1.1 can be brought into contact with the roll shell 3, it is necessary to design the advancing pressure in a controllable or regulatable way. The advancing pressure can thus be regulated via a regulable holding torque of the motor or indirectly via a spring element which is located between the adjusting element and the sealing strip. If the sealing strip is already in contact with the roll shell, a force that is gradually increasing with increasing deformation of the spring element and with which the sealing strip is pressed against the roll shell can be applied via a further adjustment of the actuating element. It is advantageous that the actuating element is positioned in such a way that a small gap forms between sealing strip and roll shell.

FIG. 4 shows schematically the design of the suction box 4 with two inventive sealing strip systems 1, 2. The direction of travel of the roll shell 3 is indicated by an arrow. Viewed in direction of travel, the first front sealing strip system 1 is embodied according to FIG. 2, viewed from the direction of travel the second rear sealing strip system 2 is designed according to FIG. 3. FIG. 4 shows how both sealing strip systems 1, 2 form the lateral delimitation of the suction box 4. Thus inside the suction box 4 forms an area 4.1 which is sealed from the remaining interior of the suction roll.

As symbolically shown, the inside of the suction box 4 comprises a pressure sensor 5 for measuring the negative pressure and/or vacuum in the sealed area 4.1. Alternatively, the determination of the negative pressure in the suction box 4 can also occur in or through the vacuum pump which is used to create the vacuum in the sealed area 4.1. The first sealing strip system 1 comprises a temperature sensor system 26 for determining the temperature in the sealing strip 2.1, which preferably consists in the embodiment of several sensor units 6 that are integrated into the sealing strip 2.1 according to FIG. 1. The second sealing strip system 2 comprises further a sensor for noise detection, which preferably consists in the embodiment of a sound sensor 7 integrated into the sealing strip mounting 2.2.

The first sealing strip system 1 comprises an adjusting mechanism to change position of the sealing strip 1.1, which preferably contains an advancing tube 1.3. The advancing pressure of the sealing strip 1.1 and/or the distance between sealing strip 1.1 and roll shell 3 is controllable and/or regulable via the adjustment mechanism. The first sealing strip system 1 comprises a lubricant water supply, whereas the amount of inserted lubricant water is controllable and regulable. The lubricant water supply consists preferably of an embodiment of a spray tube 1.5 integrated sealing strip mounting 1.2. The second sealing strip system 2 comprises an adjustment mechanism to change position of the front area of the sealing strip 2.1 which preferably contains an advancing tube. The advancing pressure of the front area of the sealing strip 2.1 and/or the distance between the front area of the sealing strip 2.1 and the roll shell 3 is controllable and/or regulable via the adjustment mechanism. The second sealing strip system 2 comprises a second adjustment mechanism for changing the position of the rear area of the sealing strip 2.1, which preferably comprises the stepper motor.

The opening angle between the rear area of the sealing strip 2.1 and the roll shell 3 is controllable and/or regulable via the second adjustment mechanism.

The second sealing strip system 2 comprises a lubricant water supply, whereas the amount of inserted lubricant water is controllable and/or regulable. The lubricant water supply consists preferably of the embodiment of a spray tube 2.5 integrated into the sealing strip mounting 2.2.

The inventive adjustment method consists in a first embodiment in the determination of the negative pressure or vacuum in the suction box 4, whereas the advancing pressure or the distance to the roll shell 3 of the first sealing strip 1.1 and the advancing pressure or the distance to the roll shell 3 of the front area of the second sealing strip 2.1 are regulated in such a way that the minimal advancing pressure or the maximum distance is set, which is permissible in order to maintain the vacuum at the desired level inside the suction box 4. The advancing pressure or the distance can thereby be varied for both sealing strips 1.1, 2.1 together, for example by applying the same pressure to both pressure tubes 1.3, 2.3. A particular advantage of this inventive adjustment method is the minimization of the energy consumption of the roll, due to the fact that the vacuum is maintained with minimal advancing pressure, which results in high energy savings. It is also possible to separately regulate the advancing pressure or optionally the distance by applying determinable further control standards for both sealing strip 1.1, 2.1, for example by pressing the worn out strip with less force than the less worn out strip.

In the first embodiment of the adjustment method it preferably further comprises a temperature sensor system 16, 26 for detecting the sealing strip temperature of each sealing strip 1.1, 2.1. The amount of used lubricant water for sealing strip 1.1 is thereby controlled or regulated based on the measured values by the temperature sensor system 16 and the amount of used lubricant water for sealing strip 2.1 is thereby controlled or regulated based on the measured values by the temperature sensor system 26. The regulation of the lubricant water amount based on the temperature of the sealing strip 1.1, 2.1 can also be applied or is also preferable without the above mentioned regulation of the advancing pressure.

A particular advantage of this inventive control and/or regulation method is the minimization of water needs and thus considerably lower water consumption compared to conventional spray rubes.

In addition to the first embodiment, the second embodiment of the inventive regulation further comprises the measurement of the noise level after or on the second sealing strip system 2 and based on the measured values of the distance of the rear area of the sealing strip 2.1 to the roll shell 3 and with that the regulation of the opening angle of the gap between sealing strip 2.1 and roll shell 3, resulting in a minimal noise level.

This method is also preferably applicable separately from the above described method, due to the noise development on conventional sealing strips, which reaches up to 110 dBA and thus constitutes a possible health hazard. The constant noise optimization reduces this potential risk and further preferably creates the most silent and thus most comfortable work environment possible.

Preferably the opening angle of the gap can also be regulated or controlled in such a way that the frequency of the noise is changed, in particular to lower frequencies. The possible disturbing effect of the noise is generally increased significantly by its tonality, which is to be considered when creating a rating level with an additional tonality added to the measured value, the opening value of the gap can also be preferably regulated or controlled that the frequency of the noise is changed according to the predetermined models or stochastically in order to reduce the tonality.

A paper machine generally comprises a variety of suction rolls and thus the regulation or control of the noise emissions of all suction rolls is preferably to be carried out by a central data processing system, such as in particular a mini-server, in order to prevent that the noise emissions of two or more suction rolls contain a simultaneous maximum in the same frequency range.

The invention provides that all measured values of all sensors are transmitted to a mini-server, preferably wireless, in which the regulation and control standards are stored, which can optionally be amended by a program or a user. Using the measured values, the min-server calculates the required adjustment variables for controlling the actuator. The mini-server is preferably connected to a display and input device, in particular wireless, in order to display the operation parameters and/or permit manual amendments.

A particularly advantage of the present invention is that the intelligent system ensures the most energy efficient and most noiseless operation possible and facilitates a preventative maintenance for controlling all important parameters within a suction roll, which is centrally monitored preferably via a mini-server and can be changed dependent on one another either by the system or by the user. The system is based on components with sensors such as in particular sealing strip, pressure tube, sealing strip mounting and spray tube, which preferably supply constant information about the process that prevents outside insight and/or outside control and provide thus information about the operation mode of the suction roll in singular form.

The invention claimed is:

1. A method for operating a sealing system of a suction roll, the method comprising:

arranging at least one suction box inside a roll shell of the suction roll; and arranging two sealing strip systems which seal a suction zone against the inner side of the roll shell of the suction roll, each sealing strip system comprising:

a sealing strip mounting;

a sealing strip, which is inserted in the sealing strip mounting, wherein at least one device for inserting lubricant is assigned to at least one of said sealing strips, wherein a temperature in or on one or each of said sealing strips is detected and the amount of inserted lubricant is regulated or controlled based on the temperature of the respective sealing strip.

2. The method according to claim 1, further comprising detecting negative pressure inside the suction box as actual pressure and regulating or controlling advancing pressure of the sealing strips or a distance of the sealing strips to the inner side of said roll shell based on the actual pressure.

3. The method according to claim 2, wherein the advancing pressure of the sealing strips is regulated to the minimum value required for maintaining or setting a predetermined or predeterminable negative pressure in the suction box.

4. The method according to claim 2, wherein the distance of the sealing strips to the inner side of said roll shell is regulated to the value required for maintaining or setting a predetermined or predeterminable negative pressure in the suction box.

5. The method according to claim 1, further comprising detecting and/or monitoring abrasion of the sealing strips during operation.

6. The method according to claim 5, further comprising regulating or controlling the ratio of the advancing pressure of both sealing strips or the distance of the sealing strips to the inner side of said shell on basis of the abrasion of the sealing strips.

7. The method according to the claim 1, further comprising rotating the roll shell around its axis, wherein the roll shell travels from a first sealing strip system towards a second rear sealing strip system, wherein viewed from the direction of travel of the roll shell, the noise level after or on the second rear sealing strip system is detected and the opening angle of the gap between the rear area of the sealing strip of the rear sealing strip system and the inner side of said shell is regulated or controlled on the basis of the detected noise level.

8. The method according to claim 7, wherein the opening angle of the gap between the rear area of the sealing strip of the rear sealing strip system and the inner side of said shell are set as adjustment variable to the value at which the minimal noise level sets in.

9. The method according to claim 1, further comprising transmitting the measured values of the sensors to a mini-server and the mini-server calculates adjustment signals for the regulation of the sealing systems.

10. A sealing system for a suction roll having a roll shell, the sealing system comprising:

at least one suction box inside the roll shell of the suction roll;

two sealing strip systems which seal the suction box on two opposite sides of the suction box against the roll shell of the suction roll, each sealing strip system comprising:

a sealing strip, wherein in at least one sealing strip are at least two temperature sensors integrated or inserted, wherein at least one temperature sensor comprises a larger distance to the surface of the sealing strip, facing the inner wall of the roll shell, than the other temperature sensor or temperature sensors.

11. The sealing strip system according to claim 10, wherein a sealing strip has at least one sensor unit integrated or inserted, wherein the sensor unit comprises a circuit board with at least two temperature sensors, wherein the temperature sensors of the sensor unit are spaced a different distance to the surface of the sealing strip facing the roll shell.

12. The sealing strip system according to claim 11, wherein each sensor unit comprises a power supply and a microchip with a radio module.

13. The sealing strip system according to claim 10, wherein each sealing strip is inserted into a sealing strip mounting, wherein in at least one sealing strip mounting is integrated at least one spray tube, wherein the sealing strip mounting has openings that run from the spray tube to the outside of the sealing strip mounting which, viewed from the direction of travel of the roll shell, is located in front of the sealing strip.

14. The sealing strip system according to claim 13, wherein a sound sensor is integrated into the sealing strip mounting or mounted onto it.

15. The sealing strip system according to claim 10, wherein each sealing strip is inserted into a sealing strip mounting, whereas at least one sealing strip mounting comprises an adjustment element via which the distance of the sealing strip to the roll shell is adjustable, whereas the adjusting element is adjustable in its position via a motor and said motor can hold the adjusting element in a desired position.

16. The sealing strip system according to claim 15, wherein the adjustment element comprises an element displaceable in longitudinal direction of the sealing strip comprising at least one inclined surface, whereas the sealing strip or a height adjustable element connected to the sealing strip is led along this inclined surface.

17. The sealing strip system according to claim 15, wherein the adjustment element acts upon the rear area of the sealing strip, thus facilitating the setting of different values for the distance of the rear distance to the sealing strip to the roll shell from the front area of the sealing strip.

18. The sealing strip system according to claim 17, wherein the advancing pressure of the front end of the sealing strip is adjustable with an advancing tube.

19. The sealing strip system according to claim 17, wherein the front area of the sealing strip also comprises an adjustment element via which the distance of the front area of the sealing strip to the roll shell is adjustable, whereas the adjustment element is adjustable in its position via a motor and said motor can hold the adjusting element in a desired position.

20. The sealing strip according to claim 15, wherein a spring element is mounted in between the sealing strip and the adjustment element.

* * * * *